US005443898A

United States Patent [19]

Gessner et al.

[11] Patent Number: 5,443,898

[45] Date of Patent: Aug. 22, 1995

[54] NONWOVEN WEBS AND METHOD OF MAKING SAME

[75] Inventors: Scott L. Gessner, Encinitas, Calif.; Marcus C. Merriman, Fairport, N.Y.; Charles H. Parson, Durham, Pa.

[73] Assignee: Fiberweb North America, Inc., Simpsonville, S.C.

[21] Appl. No.: 84,523

[22] Filed: Jun. 29, 1993

[51] Int. Cl.[6] ..... B32B 27/00

[52] U.S. Cl. ..... 428/286; 156/167; 156/176; 156/179; 428/284; 428/903

[58] Field of Search ..... 428/224, 903, 284, 286, 428/296; 156/167, 176, 179

[56] References Cited

U.S. PATENT DOCUMENTS

| | | |
|---|---|---|
| 3,102,323 | 9/1963 | Adams . |
| 3,287,342 | 11/1966 | Walton . |
| 3,608,001 | 9/1971 | Kawalski et al. . |
| 3,887,534 | 6/1975 | Baba et al. . |
| 3,940,379 | 2/1976 | Castagna et al. . |
| 3,953,655 | 4/1976 | Steinkamp et al. . |
| 3,978,185 | 8/1976 | Buntin et al. . |
| 3,988,406 | 10/1976 | Nakamura et al. . |
| 4,056,499 | 11/1977 | Taylor . |
| 4,061,694 | 12/1977 | Castagna . |
| 4,143,196 | 3/1979 | Simm et al. . |
| 4,282,076 | 8/1981 | Boynton . |
| 4,359,495 | 11/1982 | Schroeder et al. . |
| 4,374,938 | 2/1983 | Verhelst et al. . |
| 4,451,589 | 5/1984 | Morman et al. . |
| 4,454,092 | 6/1984 | Shimizu et al. . |
| 4,552,930 | 11/1985 | Hirota et al. . |
| 4,578,431 | 3/1986 | Shaw et al. . |
| 4,647,593 | 3/1987 | Bartosiak et al. . |
| 4,677,025 | 6/1987 | Davison et al. . |
| 4,707,524 | 11/1987 | Ehrig et al. . |
| 4,753,843 | 6/1988 | Cook et al. . |
| 4,833,195 | 5/1989 | Adur et al. . |
| 4,833,209 | 5/1989 | Beijleveld et al. . |
| 4,897,452 | 1/1990 | Berrier et al. . |
| 4,900,781 | 2/1990 | Hirai et al. . |

FOREIGN PATENT DOCUMENTS

| | | |
|---|---|---|
| 208353 | 1/1987 | European Pat. Off. . |
| 287239 | 10/1988 | European Pat. Off. . |
| 322945 | 7/1989 | European Pat. Off. . |
| 1405950 | 9/1975 | United Kingdom . |
| 1407356 | 9/1975 | United Kingdom . |

*Primary Examiner*—James J. Bell

*Attorney, Agent, or Firm*—Bell, Seltzer, Park & Gibson

[57] ABSTRACT

A process for producing nonwoven webs having improved strength properties at high throughputs is provided. In the process, a non-uniform blend of a polyolefin and a prodegradant is formed. The non-uniform blend is then rapidly heated to cause the substantially immediate thermal degradation of the prodegradant, thus providing a non-uniformly degraded polyolefin having a fraction substantially reduced in molecular weight and a fraction substantially unaffected in molecular weight as compared to the starting polyolefin.

30 Claims, 1 Drawing Sheet

NONWOVEN WEBS AND METHOD OF MAKING SAME

FIELD OF THE INVENTION

The present invention relates to nonwoven webs and to processes for producing nonwoven webs. More specifically, the invention relates to processes for producing meltblown nonwoven webs having improved properties at increased throughputs.

BACKGROUND OF THE INVENTION

Nonwoven webs are used in a variety of products, including the manufacture of medical fabrics, wiping cloths, and disposable personal care products, such as diapers, sanitary napkins and the like.

There are a wide variety of techniques and polymers used to produce nonwoven products. For example, nonwoven webs may be produced by meltblowing techniques. In meltblowing, a thermoplastic resin is fed into an extruder, heated, and then fed to a special meltblowing die typically comprising a plurality of linearally arranged, small diameter capillaries. The resin emerges from the die orifices as molten threads into a high velocity stream of gas, usually air. The air attenuates the polymer into a blast of fine fibers and/or filaments, which are collected on a moving screen placed in front of the blast. The fibers entangle to form a cohesive web.

Typically, polymer properties affect both processing conditions and properties of the nonwoven web produced. For example, low molecular weight polymers exhibit lower viscosities and higher melt flow rates. Thus, these polymers attenuate more readily, allowing a high throughput of polymer. However, the resultant web is weak because the low molecular weight polymer is inherently weak. That is, the polymer relaxation time is shorter than the attenuation time (time from capillary exit to solidification). In contrast, high molecular weight polymers typically exhibit higher strength but also have high viscosities and lower melt flow rates. Thus, these polymers flow less readily and although a stronger web can be produced, processability is impaired.

A polymer's ability to attenuate rapidly to form fine diameter fibers or filaments with minimal breakage is another important consideration in choosing a polymer. Typically, a good meltblowing resin is composed of polymer chains of about the same size or molecular weight (or with a narrow range, i.e., a narrow molecular weight distribution or "MWD"). A poor meltblowing polymer is thought to have a wide range of different sized polymer chains (or a broad MWD). Thus, prior procedures have attempted to provide polymers with a low molecular weight and a narrow molecular weight distribution.

Molecular weight and molecular weight distribution are difficult parameters to control in conventional polymerizations, such as propylene polymerizations using a Ziegler-type catalyst. Control of such parameters requires use of chain terminators or transfer agents, and the results obtained are strongly dependent upon the polymerization conditions. Thus, varying the polymerization process to produce a polymer having a desired average weight and molecular weight distribution can be difficult.

Given the difficulties of conventional polymerization techniques, typically to prepare a processable polymer, efforts have shifted from controlling polymerization parameters to altering the resultant polymer. For example, a reactor-prepared polymer having a high molecular weight can be treated to provide a polymer having a molecular weight and molecular weight distribution within a desired range. Typically, the reactor-produced polymer is degraded, i.e., subjected to a molecular scission step using thermal, radiation or chemical degradation techniques.

Prior procedures have emphasized the importance of uniform decomposition of the reactor-produced polymer to provide a processable product having a lower average molecular weight and a narrow molecular weight distribution. For example, in chemical degradation processes, a peroxide-based catalyst is often used to attack the polymer chain. A narrow molecular weight distribution is achieved by uniformly mixing the polymer and the catalyst so that upon initiation, the catalyst attacks and, through a free radical mechanism, randomly cleaves the molecules. Since the free radical initiator is well mixed into the polymer prior to activation, the uniformity of degradation is enhanced.

U.S. Pat. No. 4,451,589 discloses one such process for degrading polymers. In this process, the polymer is degraded stepwise by first forming pellets of the polymer and the prodegradant under condition initiating a portion of the prodegradant. In a subsequent step, the pellets are processed at which time the remainder of the product reacts. The prodegradant must be dispersed uniformly to produce a low viscosity polymer. U.S. Pat. No. 3,940,379 discloses another such process, wherein the degradation of propylene polymers is controlled using oxygen and a peroxide.

Such procedures can inherently narrow the molecular weight distribution and reduce the weight average molecular weight of the polymer, thereby providing a processable polymer. However, although these materials do provide improved processability by lowering molecular weight and narrowing the molecular weight distribution, processability is nevertheless improved at the cost of fiber and web strength as discussed previously.

SUMMARY OF THE INVENTION

The present invention provides a process for meltblowing a polymer at high throughputs comparable to throughput speeds for low molecular weight polymers while providing fibers and nonwoven fabrics having strength properties comparable to those produced from high molecular weight polymers.

In the process of the invention, a non-uniform blend is formed of the polymer, preferably a polyolefin, and a prodegradant. The non-uniform blend is rapidly heated to provide substantially immediate activation of the prodegradant so that some portions of the polymer in the blend are highly degraded while other portions of the polymer are degraded little, if at all. The resultant material is believed to have a broader and/or skewed molecular weight distribution relative to the starting polymer and can be spun at high throughput conditions while providing meltblown webs of relatively high strength.

Advantageously the polyolefin can have a tertiary carbon group attached to the polymer backbone, or an electron-withdrawing group. Preferred polyolefins include polypropylene, poly(4-methyl-1-pentene) ("TPX"), and co- and terpolymers thereof. In one embodiment of the invention, the process is used to produce nonwoven webs from polypropylene reclaimed from staple fiber, thermalbonding and spunbonding processes.

Prodegradants useful in the invention include free radical generating chemicals known in the art, preferably an organic prodegradant, and more preferably an organic peroxide-based prodegradant. The prodegradant is added to the polymer in an amount sufficient to produce the final desired polymer properties, preferably in an amount sufficient to give an average concentration of prodegradant of from about 0.05 to about 0.5% prodegradant by weight of the polymer, and more preferably an average concentration of about 0.2% prodegradant by weight polymer.

The prodegradant may be added to the polymer directly or in the form of a concentrate, preferably as a noncompounded concentrate. Where the prodegradant is added to the polymer as a concentrate dispersed on or within polymer particles or pellets, preferably the prodegradant level in the concentrate is above about 10%, more preferably above about 25%, and most preferably above about 30% by weight of the concentrate. Concentrates of this level are preferably added to the polymer in an amount of from about 1 to 10%, and preferably about 4 to 5%, by weight of the polymer, based on the total polymer weight.

After the non-uniform blend of the polymer and the prodegradant is formed, the blend is rapidly heated to a temperature sufficient to cause the prodegradant to substantially immediately degrade. As a result, some portions of the polymer are highly degraded by the prodegradant while some portions of the polymer are only slightly, if at all, degraded. Although not wishing to be bound by any theory of the present invention, it is believed that by carefully selecting the prodegradant concentration and/or processing conditions of a polymer, the prodegradant can actually widen the molecular weight distribution of the polymer or alter the skew of the molecular weight distribution by increasing the ratio of low molecular weight to high molecular weight species, as opposed to narrowing the molecular weight distribution as in the prior art. The resultant material processes as if it were a low molecular weight polymer but provides fibers and nonwoven fabrics having a higher strength than those produced by low molecular weight polymers.

BRIEF DESCRIPTION OF THE DRAWING

In the drawing which forms a portion of the disclosure of the invention.

DETAILED DESCRIPTION OF THE INVENTION

Figure 1:
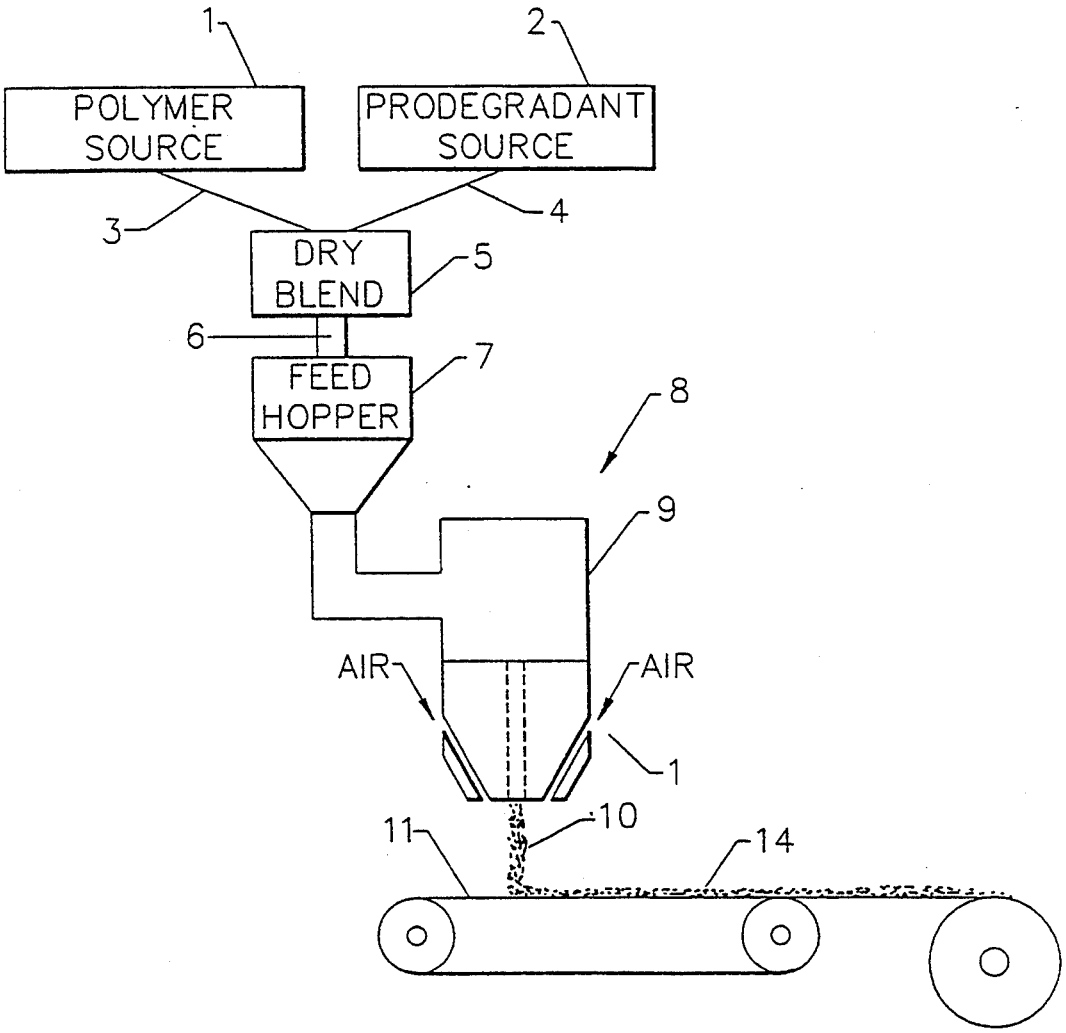
FIG. 1 diagrammatically illustrates a preferred method and apparatus for processing a polymer to produce a nonwoven fabric according to the invention.

In the following detailed description of preferred embodiments of the invention, specific terms are used in describing the invention; however, these are used in a descriptive sense only and not for the purpose of limitation. It will be apparent that the invention is susceptible to numerous variations and modifications within its spirit and scope.

FIG. 1 schematically illustrates a preferred method and apparatus for producing the nonwoven fabrics according to the process of the invention. In FIG. 1, a polymer source 1 and a prodegradant source 2 are provided. The polymer from polymer source 1 is prepared for use in the process of the invention by forming a non-uniform or heterogenous blend of the polymer with the prodegradant. The term "non-uniform" as used herein refers to a blend of the polymer and the prodegradant in which the prodegradant is poorly dispersed throughout the polymer, i.e., exists in discrete areas of high concentration relative to the surrounding polymer, and is described in more detail below.

Typically, the non-uniform blend of the polymer and the prodegradant is prepared by dry blending solid state forms of the polymer and the prodegradant, i.e., in powder form. However, the non-uniform blend may be prepared using any of the techniques known in the art for preparing a simple blend, such as preparing a non-uniform blend from the components in liquid form, by preparing coated pellets, and the like.

FIG. 1 illustrates preparation of the non-uniform blend by dry blending powder forms of the constituent parts of the blend. A polymer from polymer source 1 is supplied through feedline 3 to a dry blending apparatus 5. Dry blending apparatus 5 may be any of the dry blending apparatus known in the art. Similarly, a prodegradant from prodegradant source 2 is supplied to the dry blending apparatus 5 through feed line 4. There, the polymer and the prodegradant are mixed to provide a non-uniform blend, as discussed in more detail below.

The polymer used in the process of the invention can be any of the various thermoplastic fiber-forming polymers which are characterized by their ability to undergo catalytic chain scission known to the skilled artisan.

Preferably, the polymer is a polyolefin. Advantageously, the polyolefin comprises a tertiary carbon group, such as methyl, ethyl, propyl, isopropyl, and the like, in the polymer backbone, or an electron-withdrawing group. Exemplary polyolefins include but are not limited to polypropylene, poly(4-methyl-1-pentene), and co- and terpolymers thereof. Advantageously the polymer has a melt flow rate less than about 100, and more preferably less than about 50. The invention is particularly useful for processing reclaimed polypropylene, such as polypropylene staple fibers reclaimed from carding and thermalbond processes, polypropylene filaments reclaimed from spunbonding processes, and polypropylene reclaimed from nonwoven laminate processes.

Prodegradants useful in the invention include any of the free radical generating chemicals known in the art. Such chemicals when exposed to heat decompose to form at least one, and typically two or more free radicals which attack the polymer, and thus degrade or break the bonds of the polymeric material. Any of the prodegradants known in the art may be used in accordance with the present invention, but preferably the prodegradant is an organic prodegradant, and more preferably an organic peroxide-based prodegradant. Illustrative of the prodegradants which can be suitably used in the process of the invention are 2,3-dimethyl hexane, 1,5-bis-dibutyl peroxide; 2,5-dimethyl-2,5-di(t-butylperoxy)hexane-3 (e.g., Lupersol 130, available from Lucidol Division, Pennwalt Corp.); di(2-tert-butyl-peroxy-isopropyl)benzane (e.g., Vul-Cup R available from Hercules Inc.); 4-methyl-4-t-butyl peroxy-2-pentanone (e.g., Lupersol 120); 3,6,6,9,9-pentamethyl-3-(ethyl acetate) (e.g., USP 138 available from Witco Chemical Corp.); 1,2,4,5-textraoxy cyclonanone; 2,5-dimethyl 2,5-bis-(t-butylperoxy) hexane (e.g., Lupersol 101); and the like.

The prodegradant is added to the polymer in a total amount sufficient to produce the final desired polymer properties, i.e., in an amount sufficient to give an average concentration of prodegradant of from about 0.05 to about 0.5% prodegradant by weight of the polymer, and preferably in an amount sufficient to provide an average concentration of about 0.2% prodegradant by weight polymer. The prodegradant may be added to the polymer directly or in the form of a concentrate, preferably as a noncompounded concentrate in order to achieve a non-uniform blend. Typically, the non-uniform blend of the invention is formed by dispersing the prodegradant in the polymer in a concentrated form such that the actual concentration of the prodegradant as dispersed in the blend is much higher than the theoretical concentration based on the weight of the blend as a whole.

When the prodegradant is added to the polymer as a concentrate dispersed within or on polymer particles or pellets, preferably the prodegradant level in the concentrate is above about 10%, preferably above about 25% and more preferably above about 30% by weight of the concentrate. Such concentrate is added to the polymer in an amount of from about 1 to 10%, and preferably about 4 to 5%, by weight of the polymer.

As stated above, the prodegradant decomposes when exposed to heat to form one or more radicals. The rate of prodegradant decomposition is typically defined in term of the half-life of the prodegradant, i.e., the time required at a given temperature for one-half of the prodegradant molecules to decompose. To provide a non-uniform blend of the polymer and the prodegradant of the invention, the prodegradant used in accordance with the present invention should have a relatively short half-life, as discussed in greater detail below. For example, the half life of peroxide prodegradants useful for the present invention can be calculated using the following equation: $t^{\frac{1}{2}}$ (minutes)$=8.266\times10^{-20}$ exp ($2.020\times10^{4}$/degrees Kelvin), yielding a half life of about $6.0\times10^{-1}$ to about $1.2\times10^{-3}$ at 250° C. to about 350° C.

The term "non-uniform" as used herein refers to a blend of the polymer and the prodegradant in which the prodegradant is poorly dispersed throughout the polymer, i.e., exists in discrete areas of high concentration relative to the surrounding polymer, so that samples of the polymer blend can be found wherein the actual concentration of prodegradant differs widely from the concentration of the prodegradant averaged over the entire weight of the blend. That is, within the blend, the concentration of the prodegradant typically is much higher in some portions of the blend and much lower in other portions of the blend than the theoretical concentration of the peroxide for that sample based upon the total prodegradant concentration distributed equally throughout the polymer and prodegradant blend. The prodegradant/polymer blend is heterogeneous, not homogenous.

For example, the concentration of the prodegradant in the blend may be described in terms of parts per million ("ppm," or the weight of the solute, i.e., the prodegradant, divided by the weight of solution, i.e., the polymer, multiplied by $10^6$). Accordingly, a non-uniform blend prepared in accordance with the invention having a total prodegradant concentration of 0.2% would result in a theoretical average concentration of the prodegradant of about 2000 parts per million in the blend. However, because of the non-uniform nature of the blend, an appropriately sized sample of such a blend would provide local concentrations much higher or much lower than the expected theoretical concentration depending on where the sample was taken. In the non-uniform blend of the invention, such actual concentrations at the high end range from about 20,000 to about 200,000 or greater parts per million prodegradant in the polymer blend. At the low end of the concentration scale, the concentration of the prodegradant in the non-uniform blend ranges from about 0 to about 500 parts per million prodegradant in the blend.

After the non-uniform blend of polymer and prodegradant is formed, the non-uniform blend is heated rapidly to a temperature sufficient to cause the substantially immediate thermal degradation of the prodegradant. For example, the dry blend of prodegradant and polymer formed in apparatus 5 is fed through line 6 to feed hopper 7 of a melt apparatus, generally designated in FIG. 1 as 8. The blend is then transferred from feed hopper 7 to extruder 9. Here, the blend is heated to the melt temperature of the polymer, and the prodegradant reacts immediately upon reaching the melt temperature of the polymer.

As stated above, it is believed that the prodegradant decomposes upon exposure to heat to form two or more radicals. The radicals attack the polymer of the non-uniform blend, splitting the polymer molecule. Because the polymer blend is non-uniform, the prodegradant radicals attack molecules of the polymer in the proximal vicinity thereof while those molecules more distant are essentially unaffected. As a result, the polymer is non-uniformly degraded, i.e, some portions of the polymer are highly degraded while other portions of the polymer are only slightly degraded, if at all. As a result, the molecular weight distribution of the polymer is believed to widen, or become bimodal, because a low molecular weight fraction results. It is believed that the low molecular weight fraction resulting from activation of the prodegradant in the non-uniform blend acts as a kind of internal lubricant during processing, and thus provides increased throughput of the polymer during processing.

The degree of mixing of the non-uniform blend is dependent at least in part on the particular melt spinning apparatus used. As will be understood by those skilled in the art, differing rates and degrees of mixing occur in different extrusion processes. That is, some extrusion processes accomplish a higher degree of mixing more rapidly than other processes. Thus, the degree of dry mixing required to prepare the non-uniform blend of the invention is inversely related to the rate and degree of mixing that occurs during the extrusion process. For example, if a high degree of mixing or a fast rate of mixing occurs during the early stages of the extrusion process, then the polymer to be extruded can be prepared using a highly concentrated prodegradant and/or with a low degree of mixing prior to extrusion. Conversely, for extrusion processes that achieve less rapid mixing and a lesser degree of mixing, a higher degree of mixing and/or a lower concentration of prodegradant may be used.

In addition, the selection of a prodegradant having a particular half life is also affected by the rate and degree of mixing achieved in the extrusion process. In extrusionprocesses providing relatively rapid mixing, a prodegradant having a shorter half life is preferred than when using an extrusion process which provides less rapid mixing.

For extrusion processes providing more rapid mixing, a prodegradant having a shorter half life is desired so that the prodegradant will more rapidly decompose and attack the polymer chain, thus maintaining the non-uniform degradation of the polymer before the non-uniform blend becomes relatively homogenous. In contrast, for extrusion processes which provide less rapid mixing, a prodegradant having a longer half life may be used. Because extrusion provides less rapid mixing, there is a greater margin of time for activation of the prodegradant before the mixture of polymer and prodegradant becomes more uniform.

The degradation of a prodegradant is activated at a temperature of about 125° C. to about 350° C., add preferably a temperature of about 200° C. Although the process of the invention has been described as providing a dry blend of the polymer and the prodegradant which is fed to an extruder wherein the prodegradant is initiated, the polymer can be fed concurrently with the prodegradant to an extruder, i.e., the prodegradant can be added in-line so long as there is initially poor mixing.

After the polymer and prodegradant blend is rapidly heated to initiate the decomposition of the prodegradant and provide non-uniform degradation of the polymer, the polymer is then further mixed and meltblown using any of the meltblowing processes and apparatus known in the art. FIG. 1 illustrates a conventional meltblowing apparatus, designated generally as 8, for meltblowing a fabric according to the invention. The apparatus 8 forms a meltblown fiber stream 10 which is deposited onto a forming wire 11. Melt blowing processes and apparatus are known to the skilled artist and are disclosed, for example, in U.S. Pat. No. 3,849,241 to Buntin et.al. and U.S. Pat. No. 4,048,364 to Harding, et. al.

The meltblowing process involves extruding a molten polymeric material through fine capillaries into fine filamentary streams. The filamentary streams exit the melt blowing spinneret head where they encounter converging streams of high velocity heated gas, typically air, supplied from nozzles 12 and 13. The converging streams of high velocity heated gas attenuate the polymer streams into meltblown filaments and fibers. The meltblown fibers are collected on the moving forming screen 11 to form a layer 14.

The nonwoven webs prepared in accordance to the invention may contain fibers comprising a material different from that disclosed above. The web 14 may comprise microfibers disclosed above mixed with natural fibers, such as cotton fibers, wool fibers, silk fibers, or the like, or mixed with cellulose-derived fibers, such as wood fibers, wood pulp, rayon fibers or the like. The microfibers may also be mixed with man-made fibers, such as polyester fibers, acrylic fibers, polyamide fibers, polyolefin fibers and copolymers and blends of the same, as well as synthetic fibrids and synthetic pulps.

The present invention thus provides an improved process for preparing a nonwoven web. The polymer and the prodegradant blend can be processed at high throughput rates comparable to low molecular weight polymers, to produce nonwoven webs having strength properties comparable to those produced from high molecular weight polymers.

The nonwoven webs of the present invention may be used as a nonwoven component in a variety of products, such as bandaging materials, wipes, medical fabrics, such as a sterile wrap or surgical gown, diapers, and personal hygiene products. The nonwoven fabrics of the present invention are particularly useful as a barrier layer in such products. For example, the nonwoven fabrics of the present invention may be used as a meltblown web in a composite fabric having two or more webs by forming a spunbonded web/meltblown web laminate; spunbonded web/meltblown web/spunbonded web laminate; carded web/meltblown web laminate; carded web/meltblown web/carded web laminate; carded web/meltblown web/spunbonded web laminate; spunbonded web/meltblown web/spunbonded web/carded web laminate; carded web/spunbonded web/meltblown web/spunbonded web/carded web laminate; and the like.

The following examples are provided to illustrate the present invention, and should not be construed as limiting thereof.

EXAMPLE 1

Samples of meltblown webs according to the invention were prepared as follows. Polypropylene staple fibers were reclaimed from carded thermally bonded nonwoven coverstock produced by Fiberweb North America. A variety of samples of a non-uniform blend of the polypropylene and prodegradant were then prepared using the reclaimed polypropylene. A first sample of the reclaimed polypropylene fibers was prepared by dry blending the polypropylene with a peroxide concentrate containing a Vul-cup R type prodegradant (Sample A). Three samples were prepared by dry blending the polypropylene with varying amounts of a polypropylene-based peroxide concentrate containing Lupersol 101 prodegradant (Samples B, C, and D). Two control samples of polypropylene available from Himont as HH 442 were also prepared (Controls 1 and 2).

The specific polypropylene resins and prodegradant concentrates used to prepare each sample, as well as the concentration of prodegradant per sample, are set out below in Table 1. The resin melt flow rates of the polypropylene control samples 1 and 2 and for the polypropylene from the degradation and processing of Samples A, B,C, and D are set out below in Table 2.

TABLE 1

| Peroxides | Concentrations |
|---|---|
| a | 5% Vulcup R Type prodegradant |
| b | 20% Conc. w/Lupersol 101 in Polypropylene |
| c | 10% Conc. w/Lupersol 101 in Polypropylene |
| d | 5% Conc. w/Lupersol 101 in Polypropylene |

TABLE 2

| Resin | Product MFR (230° C.) |
|---|---|
| Control 1 and 2 | 1423 |
| Sample A (reclaim polypropylene + 4% a) | 770 |
| Sample B (reclaim polypropylene + 1% b) | 662 |
| Sample C (reclaim polypropylene + 2% c) | 677 |
| Sample D (reclaim polypropylene + 4% d) | 680 |

The non-uniform blends A, B, C, and D and the control samples 1 and 2 were processed using meltblowing techniques. Extrusion and throughput were controlled so that filament and process quality (i.e., absence of "shot" or excessive "fly") would be substantially the same for all samples. The webs were tested for tear strength. The results, set out below in Table 3, show that nonwoven webs prepared from the non-uniform blend of reclaimed polypropylene staple fibers and the prodegradant exhibit comparable or higher root mean square cross direction (CD) and machine direction (MD) tear values than those exhibited by the fabrics prepared from the polypropylene control at the same throughput rates.

TABLE 3

| Sample | Basis Weight ($g/m^2$) | Caliper (mils) | Tensile[1] (g/ply) MD | Tensile[1] (g/ply) CD | Root Mean Square | Tear Strength (g/ply) MD | Tear Strength (g/ply) CD | Root Mean Square | Through-put[2] (lbs/hr) |
|---|---|---|---|---|---|---|---|---|---|
| Control 1 | 202 | 163 | 3420 | 5155 | 4374 | 224 | 166 | 197 | 60 |
| Sample A (4% a/PP[3]) | 207 | 156 | 4041 | 3244 | 3944 | 240 | 262 | 251 | 60 |
| Sample B (1% b/PP) | 207 | 167 | 3037 | 6125 | 4850 | 238 | 179 | 211 | 59 |
| Sample C (2% c/PP) | 195 | 167 | 2497 | 5514 | 4280 | 338 | 276 | 309 | 59 |
| Control 2 | 199 | 162 | 3320 | 5270 | 4404 | 146 | 204 | 177 | 61 |
| Sample D (4% d/PP) | 201 | 164 | 2948 | 5983 | 4685 | 300 | 278 | 289 | 59 |

[1]Grab Tensile; 3 × 6" sample; 4" gauge length; 20"/min
[2]Throughput for 10" nozzle
[3]"PP" refers to reclaim polypropylene

EXAMPLE 2

Two noncompounded peroxide concentrates were prepared using 2,5-dimethyl-2,5-bis(t-butyl peroxy)hexyne-3 (Lupersol 130, 10 hour half life at 126° C.) and mixed isomers of 1,3 and 1,4-di(t-butylperoxyisopropyl) benzene (Vul-cup R, 10 hour half life at 122° C.).

The peroxide concentrates were added to repelletized reclaimed polypropylene staple fibers available from Fiberweb North America, having a melt flow rate of 46 g/10 minutes (230° C./2.16 kg).

The type and amount of peroxide used in each sample is set out in Table 4 below. The samples were meltblown under conditions set forth in Table 4, and the resultant webs were tested for basis weight, caliper, tear and melt flow values. Note rough correlation between melt flow rate and tear values. The results of the tests are found in Table 5.

TABLE 4

| Sample | Peroxide Conc.[2] | Output (lb/hr) | Extruder[1] (RPM) | Extruder[1] (psig) | Melt (°C.) | Atten. Air[1] (SCFM) | Atten. Air[1] (°C.) | Notes |
|---|---|---|---|---|---|---|---|---|
| A | 4% Vul-cup R | 62.4 | 107 | 480 | 319 | 275 | 300 | |
| B | 10% Lupersol 130 | 66.7 | 107 | 540 | 316 | 204 | 292 | |
| C | 20% Lupersol 130 | 64.8 | 107 | 630 | 314 | 204 | 294 | |
| D | 30% Lupersol 130 | 63.6 | 107 | 710 | 314 | 204 | 294 | |
| E | 10% Vul-cup R | 62.0 | 113 | 870 | 321 | 305 | 307 | |
| F | 20% Vul-cup R | 62.0 | 115 | 1020 | 321 | 304 | 308 | |
| G | 30% Vul-cup R | 62.4 | 115 | 1180 | 321 | 304 | 300 | 3 |

[1]Key conditions for 10 inch NTC unit adjusted to give PPN-1047.
[2]Peroxide and amount in concentrate. Concentrate blended to give 0.2% peroxide final concentration in feed. Run A was Fina 8878 Concentrate. All others from Himont
[3]Unstable conditions. Surging noted, with extruded barrel pressure varying 900–1180 psig, and melt flow of web 500–810 g/10 min.

TABLE 5

| Sample | Peroxide Conc.[2] | Base Wt. ($g/m^2$) | Caliper (mils) | Tear (g/in)[1] MD | Tear (g/in)[1] CD | Melt Flow (g/10 min) |
|---|---|---|---|---|---|---|
| A | 4% Vul-cup R | 203 | 157 | 603 | 613 | 832 |
| B | 10% Lupersol 130 | 200 | 163 | 555 | 571 | 1463 |
| C | 20% Lupersol 130 | 201 | 158 | 507 | 501 | 1456 |

TABLE 5-continued

| Sample | Peroxide Conc.[2] | Base Wt. ($g/m^2$) | Caliper (mils) | Tear (g/in)[1] MD | Tear (g/in)[1] CD | Melt Flow (g/10 min) |
|---|---|---|---|---|---|---|
| D | 30% Lupersol 130 | 202 | 159 | 421 | 448 | 1278 |
| E | 10% Vul-cup R | 191 | 163 | 469 | 410 | 852 |
| F | 20% Vul-cup R | 201 | 152 | 589 | 592 | 753 |
| G | 30% Vul-cup R | 185 | 120 | 592 | 587 | 3 |

[1]Physical properties determined by Milford Standard Test Methods Nos. 006, 008, 010, 017B.
[2]See Note 2, Table 4.

[3]Melt flow was 810 g/10 min at beginning of run and 500 g/10 min at end, and throughputs varied.

EXAMPLE 3

Physical properties of medium (80 gsm) and heavy (200 gsm) basis weight meltblown webs prepared from non-uniform blends in accordance to the invention were compared with those of a nonwoven web prepared from a standard polypropylene polymer available from Himont as HH 442. A first sample was prepared using polypropylene available from Exxon as Exxon 3445 (Sample A). A second and third sample were prepared using reclaimed polypropylene available from Fiberweb North America (Samples B and C). Samples A, B and C were prepared by dry blending the polypropylene resins with a prodegradant in an amount sufficient to provide a polymer having a melt flow index as indicated below after degradation. The webs were evaluated with regard to tensile, elongation, TEA and tear values. While the root mean square (RMS) tensile values for the nonwoven webs prepared according to the invention (Samples A, B, and C) are roughly equal to the control, percent elongation, TEA, and the root mean square values of the tear values are generally superior to that of the control. The data from these tests are set forth below in Table 6:

TABLE 6

| Sample | Control | A | B | C | Control | A | B | C |
|---|---|---|---|---|---|---|---|---|
| Product MFI (after degradation) at 175° C., 2.16 kg (g/10 min) | 444 | 200 | 220 | 270 | 445 | 311 | 179 | 213 |
| Throughput (lb/hr) | 317 | 324 | 286 | 293 | 314 | 311 | 179 | 213 |
| Basis Weight (gsm) | 210 | 214 | 190 | 194 | 88 | 90 | 81 | 82 |
| Loft (mls) | 85 | 75 | 72 | 86 | 43 | 42 | 36 | 46 |
| Apparent Density ($g/cm^3$) | 0.097 | 0.112 | 0.103 | 0.089 | 0.081 | 0.084 | 0.089 | 0.07 |
| Air Perm. (cfm) | 17 | 16 | 27 | 21 | 33 | 30 | 59 | 46 |
| 1RMS Tensile (lb) | 13.1 | 14.4 | 12.3 | 11.5 | 5.1 | 4.9 | 6.0 | 5.4 |
| RMS % Elongation | 34.1 | 48.4 | 42.2 | 42.1 | 32.4 | 34.5 | 44.6 | 35.6 |
| RMS TEA (in-lbs) | 2.98 | 4.43 | 3.41 | 3.13 | 1.05 | 1 | 1.73 | 1.2 |
| RMS Tear (gms) | 215 | 286 | 328 | 231 | 113 | 101 | 125 | 102 |
| RMS "0" Gage Length (lb) | 11.7 | 12.1 | 12.7 | 10.6 | 5.34 | 5.70 | 5.15 | 5.18 |

The invention has been described in considerable detail with reference to its preferred embodiments. It will be apparent that numerous variations and modifications can be made without departing from the spirit and scope of the invention as described in the foregoing detailed specification and as defined in the following claims.

That which is claimed is:

1. A process for producing a nonwoven web, the process comprising:

forming a non-uniform dry blend of a polyolefin with a powder form of a prodegradant wherein said prodegradant is dispersed in the polyolefin so that the actual concentration of prodegradant in some portions of the non-uniform blend is significantly higher than the theoretical concentration of prodegradant based upon the total prodegradant concentration distributed equally throughout the blend;

heating the non-uniform blend to a temperature sufficient to cause the substantially immediate thermal degradation of said prodegradant and thereby provide a non-uniformly degraded polyolefin having a fraction substantially reduced in molecular weight and a fraction substantially unaffected in molecular weight as compared to the starting polyolefin; and meltblowing said non-uniformly degraded polyolefin.

2. The process according to claim 1 wherein said polyolefin has a melt flow rate of about 10 to about 100.

3. The process according to claim 1 wherein said polyolefin has a melt flow rate of about 20 to about 50.

4. The process according to claim 1 wherein said polyolefin is selected from the group consisting of polypropylene, poly-4-methyl-1-pentene and co- and terpolymers thereof.

5. The process according to claim 1 wherein said forming step comprises forming a non-uniform blend of reclaimed polypropylene and a prodegradant.

6. The process according to claim 5 wherein said reclaimed polypropylene comprises polypropylene staple fibers reclaimed from carding and thermalbond processes.

7. The process according to claim 5 wherein said reclaimed polypropylene comprises polypropylene filaments reclaimed from spunbonding processes.

8. The process according to claim 5 wherein said reclaimed polypropylene comprises polypropylene filaments or fibers reclaimed from laminated nonwoven processes.

9. The process according to claim 1 wherein said forming step comprises adding the prodegradant in an amount sufficient to provide an average theoretical concentration of prodegradant in the non-uniform blend of about 0.05 to 0.5% peroxide by weight of the polyolefin.

10. The process according to claim 1 wherein said forming step comprises dispersing the prodegradant in concentrate form wherein the prodegradant comprises above about 10% by weight of the concentrate form.

11. The process according to claim 1 wherein said forming step comprises dispersing the prodegradant in concentrate form wherein the prodegradant comprises above about 25% by weight of the concentrate form.

12. The process according to claim 1 wherein said forming step comprises dispersing the prodegradant in concentrate form wherein the prodegradant comprises above about 30% by weight of the concentrate form.

13. The process according to claim 1 wherein said prodegradant is selected from the group consisting of 2,3-dimethyl hexane, 1,5-bis-dibutyl peroxide; 2,5-dimethyl-2,5-di(t-butylperoxy)hexyne-3; di(2-tert-butyl-peroxy-isopropyl)benzene; 4-methyl-4-t-butyl peroxy-2-pentanone; 3,6,6,9,9-pentamethyl-3-(ethyl acetate); 1,2,4,5-textraoxy cyclonanone; and 2,5-dimethyl 2,5-bis-(t-butylperoxy)hexane.

14. The process according to claim 1 wherein said heating step comprises heating the blend so that at least a portion of the polyolefin is highly degraded to provide a lower molecular weight fraction of the polymer and at least another portion of the polyolefin is slightly degraded or not degraded at all.

15. The process according to claim 1 wherein said heating step comprises heating the blend to a temperature between about 125° C. and 350° C.

16. A process for producing a nonwoven web, the process comprising:

forming a non-uniform dry blend of polypropylene having a melt flow rate of about 20 to about 50 and a powder form of a prodegradant selected from the group consisting of 2,3-dimethyl hexane, 1,5-bis-dibutyl peroxide; 2,5-dimethyl-2,5-di(t-butylperoxy)hexyne-3; di(2-tert-butyl-peroxy-isopropyl)benzene; 4-methyl-4-t-butyl peroxy-2-pentanone; 3,6,6,9,9-pentamethyl-3-(ethyl acetate); 1,2,4,5-textraoxy cyclonanone; and 2,5-dimethyl 2,5-bis-(t-butylperoxy)hexane, to thereby provide a non-uniform blend having an average concentration of prodegradant in the non-uniform blend of about 0.05 to 0.5% prodegradant by weight of the polypropylene wherein said prodegradant is dispersed in the polypropylene so that the actual concentration of prodegradant in some portions of the non-uniform blend is significantly higher than the theoretical concentration of prodegradant based upon the total prodegradant concentration distributed equally throughout the blend;

heating the non-uniform blend to a temperature sufficient to cause the substantially immediate thermal degradation of said prodegradant and thereby provide a non-uniformly degraded polypropylene having a fraction substantially reduced in molecular weight and a fraction substantially unaffected in molecular weight as compared to the starting polypropylene; and meltblowing said non-uniformly degraded polypropylene.

17. A process for producing a nonwoven web, the process comprising:

heating a non-uniform dry blend of a polyolefin and a powder form of a prodegradant to a temperature sufficient to cause the substantially immediate thermal degradation of said prodegradant and thereby provide a non-uniformly degraded polyolefin having a fraction substantially reduced in molecular weight and a fraction substantially unaffected in molecular weight as compared to the starting polyolefin wherein said prodegradant is dispersed in the polyolefin so that the actual concentration of prodegradant in some portions of the non-uniform blend is significantly higher than the theoretical concentration of prodegradant based upon the total prodegradant concentration distributed equally throughout the blend; and meltblowing said non-uniformly degraded polyolefin.

18. A nonwoven fabric produced by a process comprising:

forming a non-uniform dry blend of a polyolefin with a powder form of a prodegradant wherein said prodegradant is dispersed in the polyolefin so that the actual concentration of prodegradant in some portions of the non-uniform blend is significantly higher than the theoretical concentration of prodegradant based upon the total prodegradant concentration distributed equally throughout the blend;

heating the non-uniform blend to a temperature sufficient to cause the substantially immediate thermal degradation of said prodegradant and thereby provide a non-uniformly degraded polyolefin having a fraction substantially reduced in molecular weight and a fraction substantially unaffected in molecular weight as compared to the starting polyolefin; and meltblowing said non-uniformly degraded polyolefin.

19. The nonwoven fabric according to claim 18 wherein said polyolefin is selected from the group consisting of polypropylene, poly-4-methyl-1-pentene and co- and terpolymers polymers thereof.

20. The nonwoven fabric according to claim 18 wherein said forming step comprises adding the prodegradant in an amount sufficient to provide an average theoretical concentration of prodegradant in the non-uniform blend of about 0.05 to 0.5% peroxide by weight of the polyolefin.

21. The nonwoven fabric according to claim 18 wherein said forming step comprises dispersing the prodegradant in concentrate form wherein the prodegradant comprises above about 10% by weight of the concentrate form.

22. The nonwoven fabric according to claim 18 wherein said forming step comprises dispersing the prodegradant in concentrate form wherein the prodegradant comprises above about 25% by weight of the concentrate form.

23. The nonwoven fabric according to claim 18 wherein said forming step comprises dispersing the prodegradant in concentrate form wherein the prodegradant comprises above about 30% by weight of the concentrate form.

24. The nonwoven fabric according to claim 18 wherein said prodegradant is selected from the group consisting of 2,3-dimethyl hexane, 1,5-bis-dibutyl peroxide; 2,5-dimethyl-2,5-di(t-butylperoxy)hexyne-3; di(2-tert-butyl-peroxy-isopropyl)benzene; 4-methyl-4-t-butyl peroxy-2-pentanone; 3,6,6,9,9-pentamethyl-3-(ethyl acetate); 1,2,4,5-textraoxy cyclonanone; and 2,5-dimethyl 2,5-bis-(t-butylperoxy)hexane.

25. A nonwoven fabric laminate produced by the process comprising:

forming a non-uniform dry blend of a polyolefin with a powder form of a prodegradant wherein said prodegradant is dispersed in the polyolefin so that the actual concentration of prodegradant in some portions of the non-uniform blend is significantly higher than the theoretical concentration of prodegradant based upon the total prodegradant concentration distributed equally throughout the blend;

heating the non-uniform blend to a temperature sufficient to cause the substantially immediate thermal degradation of said prodegradant and thereby provide a non-uniformly degraded polyolefin having a fraction substantially reduced in molecular weight and a fraction substantially unaffected in molecular weight as compared to the starting polyolefin;

meltblowing said non-uniformly degraded polyolefin to form a first nonwoven web;

providing a second nonwoven web adjacent said first nonwoven web; and bonding said first nonwoven web and said second nonwoven web to form a composite nonwoven fabric.

26. The nonwoven fabric laminate according to claim 25 wherein said second nonwoven web is a spunbonded web of substantially continuous filaments.

27. The nonwoven fabric laminate according to claim 26 wherein said spunbonded web is formed of a thermoplastic polymer having hydrophobic properties.

28. The nonwoven fabric laminate according to claim 25 wherein said second nonwoven web is a carded web of staple fibers.

29. The nonwoven fabric laminate according to claim 28 wherein said carded web is formed of staple fibers having hydrophilic properties.

30. The nonwoven fabric laminate according to claim 25 further comprising at least a third nonwoven web bonded with said first and second nonwoven webs.

* * * * *